US006658124B1

(12) United States Patent
Meadows

(10) Patent No.: US 6,658,124 B1
(45) Date of Patent: Dec. 2, 2003

(54) RECHARGEABLE HEARING AID

(75) Inventor: Paul M. Meadows, Sylmar, CA (US)

(73) Assignee: Advanced Bionics Corporation, Sylmar, CA (US)

( * ) Notice: Subject to any disclaimer, the term of this patent is extended or adjusted under 35 U.S.C. 154(b) by 328 days.

(21) Appl. No.: 09/811,065

(22) Filed: Mar. 16, 2001

Related U.S. Application Data

(60) Provisional application No. 60/195,578, filed on Apr. 6, 2000.

(51) Int. Cl.[7] ..... H04R 25/00

(52) U.S. Cl. ..... 381/323; 381/328

(58) Field of Search ..... 381/323, 322, 381/328, 331, FOR 127, FOR 133, FOR 135, FOR 137, 23.1, 312, 324, 327, 330; 429/94, 161, 163, 164, 175, 176, 189, 209

(56) References Cited

U.S. PATENT DOCUMENTS 4,379,988 A 4/1983 Mattatall ..... 320/4
5,610,494 A 3/1997 Grosfilley ..... 321/4
6,265,100 B1 * 7/2001 Saaski et al. ..... 429/163
6,310,960 B1 * 10/2001 Saaski et al. ..... 381/323
6,394,947 B1 * 5/2002 Leysieffer ..... 600/25

* cited by examiner

*Primary Examiner*—Curtis Kuntz
*Assistant Examiner*—Brian Ensey
(74) *Attorney, Agent, or Firm*—Kenneth L. Green; Bryant R. Gold

(57) ABSTRACT

A rechargeable hearing aid eliminates the requirement for frequent replacement of a disposable hearing aid battery. The rechargeable hearing aid features inductive recharging using a charging reservoir. In a preferred embodiment, a lithium-ion battery is used with a Completely-In-the-Canal (CIC) hearing aid. The CIC hearing aid is inserted into a reservoir throat of the charging reservoir. In a preferred embodiment a primary coil of the inductive recharger is wound around the reservoir throat, and a secondary coil of the hearing aid is wound around the diameter of the body of the CIC hearing aid, thus providing coupling of the primary and secondary coils that is independent of the rotation of the hearing aid in the charger throat.

13 Claims, 4 Drawing Sheets

RECHARGEABLE HEARING AID

The present application claims the benefit of U.S. Provisional Application Serial No. 60/195,578, filed Apr. 6, 2000, which application is incorporated herein by reference.

BACKGROUND OF THE INVENTION

The present invention relates to hearing aids, and more particularly to a recharging system for an in-the-ear rechargeable hearing aid. Such rechargeable hearing aid system eliminates the burden of replacing the hearing aid battery, and thus provides significant advantages to the elderly and others with impaired eyesight or reduced manual dexterity.

Known hearing aids utilize very small non-rechargeable batteries for their power source. Various in-the-ear hearing aids have been developed that provide both good performance and are less visible than traditional behind-the-ear hearing aids. Versions of in-the-ear hearing aids are known that are entirely in the ear canal, mostly within the ear canal, and only partially within the ear canal. In spite of their differences, all of these in-the-ear hearing aids share the requirement for a very small battery.

The need for a small battery for hearing aids has been met using known zinc air batteries. The zinc air batteries are inexpensive and have a useful life up to several days. However, the very small size that makes the zinc air batteries practical for a small hearing aid also make the batteries difficult to handle. Hearing aid users with poor eyesight or reduced manual dexterity have difficulty replacing the zinc air batteries. Both of these infirmities are associated with advanced age, and are likely to be found in hearing air users. Additionally, there is a risk of dropping and damaging the hearing aid when changing the batteries.

The disposable batteries are considered dangerous if swallowed, and therefore the ingestion of such batteries presents a health risk. There is therefore a risk of small children or infants swallowing the small hearing aid batteries, thereby requiring careful storage of new batteries, and immediate disposal of used batteries. Additionally, due to their size and shape, the batteries can be mistaken for pills, which pills are also common place with those of advanced age who frequently have diminished vision.

The chemicals used in replaceable batteries are often classified as being a toxic material. As society becomes increasingly more protective of the environment, the cost of disposing or recycling batteries will rise, and be a further deterrent to the use of disposable batteries.

One reason for the development of miniature hearing aids is to reduce the unsightly appearance of the device in the patient's ear. However, the flap covering the replaceable battery in known hearing aids is on the surface of the hearing aid that is visible when the hearing aid is inserted into the ear canal, and draws the attention that the miniature hearing aid was developed to avoid.

A rechargeable hearing aid is described in U.S. Pat. No. 5,610,494 for "Device for Recharging the Storage Battery of an Intra-auricular Prosthesis and Method for Manufacturing Same," issued Mar. 11, 1997. While the '494 patent addresses the issues raised here, it does not provide the best solution. The '494 patent teaches a recharging system requiring contacts on the exterior of the intra-auricular prosthesis (i.e., hearing aid), and a charger comprising a box with recesses matching the shape of the hearing aid, which recesses contain electrical contact which cooperate with the contacts on the hearing aid. A device according to the '494 patent therefore requires that the hearing aid be carefully positioned in the recharging device. Such positioning requirement duplicates one of the problems the '494 patent is intended to solve because the hearing aid must be placed precisely in the correct position to line up the contacts. Due to the soft structure of a hearing aid, such positioning may be difficult for those with vision problems or reduced manual dexterity. There is also a requirement to keep the contacts clean. Due to the low voltage nature of the charging circuit, even small resistance may impact charging performance. Such inefficiencies in charging are especially costly when the recharger is itself a portable battery powered recharger. The '494 patent also teaches that recharging could be accomplished using an inductive charger, but that a large coil would be required in the hearing aid that would unacceptably increase the bulk of the hearing aid. The '494 patent is incorporated herein by reference.

What is therefore needed is a rechargeable hearing aid that can be recharged without removing the battery, and which recharging may be performed without precise placement of the hearing aid within a charging device.

SUMMARY OF THE INVENTION

The present invention addresses the above and other needs by providing a rechargeable hearing aid that is recharged by placing the hearing aid in an inductive charging reservoir. Power for recharging the hearing aid battery is provided through inductive coupling of a primary coil in a charging reservoir and a secondary coil in the hearing aid. The inductive power transmission requires only a general alignment of the hearing aid with the charging reservoir. In a preferred embodiment, a lithium ion battery is used in the rechargeable hearing aid because of the energy density of the lithium ion battery and capacity for a very large number of recharges.

In accordance with one aspect of the invention, there is provided a rechargeable hearing aid that permits recharging the hearing aid battery without removing the battery from the hearing aid. Many hearing aid users are advanced in years and suffer from a loss of sight and/or manual dexterity. Such individuals often find it difficult to perform the manipulation required to replace a very small battery in a small device. The cumbersome task of removing a very small battery from a small device is replaced by simply placing the entire hearing aid in a charging reservoir.

It is also a feature of the present invention to eliminate the hazards resulting from the use of disposable batteries. For example, batteries are known to contain toxic substances, and are dangerous if swallowed. A typical hearing aid battery is similar in size and shape to common pills. A hearing aid user with poor eyesight may easily mistake a used battery for a pill, and swallow the battery. The disposable batteries are also a hazard to children who may place the batteries in their mouths. Additionally, there are also environmental costs surrounding the disposal of used batteries due to the toxic content of the batteries. Advantageously, rechargeable hearing aids avoid all of these hazards.

It is a further feature of the invention to recharge the hearing aid battery inductively. The present invention provides power required for recharging using inductive coupling between a primary coil in a charging reservoir, and a secondary coil in a hearing aid. Inductive charging advantageously eliminates the need for contacts on the exterior of the hearing aid, which contacts are required for non-inductive charging of the battery, and which contacts may become soiled, thus impairing their conductivity. Inductive charging further eliminates the requirement to precisely align hearing aid contacts with recharger contacts, which alignment is difficult for a hearing aid user with poor sight or poor manual dexterity.

It is an additional feature of the invention to eliminate the need to provide access for replacement of a disposable battery. The requirement to regularly replace the disposable battery creates a requirement that the battery be easily accessible. In known Completely-In-the-Canal (CIC) hearing aids, the disposable battery is removable through a door in the end of the hearing aid facing away from the ear drum, and the battery is located just inside the door. The placement of the battery in this location interferers with placement of the hearing aid's microphone. The placement of a rechargeable battery within the hearing aid allows the hearing aid designer to optimally select and locate the microphone. Additionally, the battery door in known CIC hearing aids is visible when the hearing aid is in the user's ear canal, thus reducing the cosmetic value of a CIC hearing aid. The use of a rechargeable battery eliminates the requirement for the unsightly door.

BRIEF DESCRIPTION OF THE DRAWINGS

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing the general principles of the invention. The scope of the invention should be determined with reference to the claims.

Figure 1A:
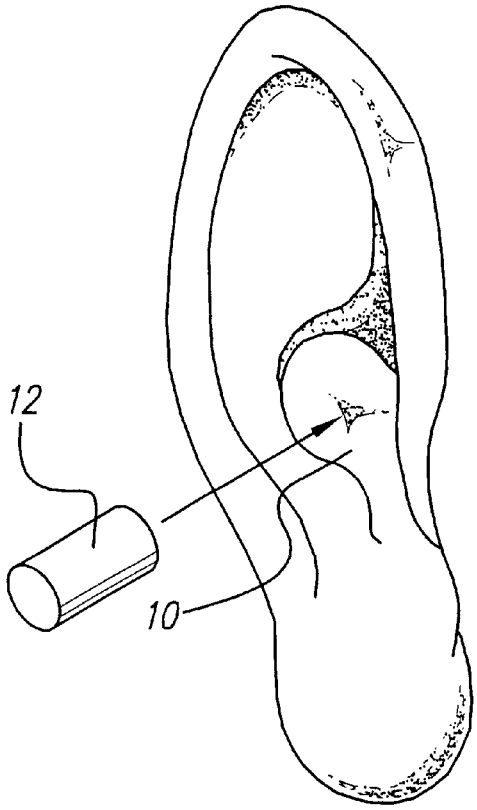
FIG. 1A depicts a Completely-In-the-Canal (CIC) hearing aid and a corresponding human ear.

The rechargeable hearing aid of the present invention provides a simple to use system relieving the hearing aid user from the cumbersome task of regularly removing and replacing the hearing aid small disposable hearing aid batteries. In a preferred embodiment, the invention is exercised in a rechargeable Completely-In-the-Canal (CIC) hearing aid 12 as shown in FIG. 1A. The CIC hearing aid 12 has the advantage of fitting entirely within an ear canal 10 of a user, and is nearly invisible when in use.

Figure 1B:
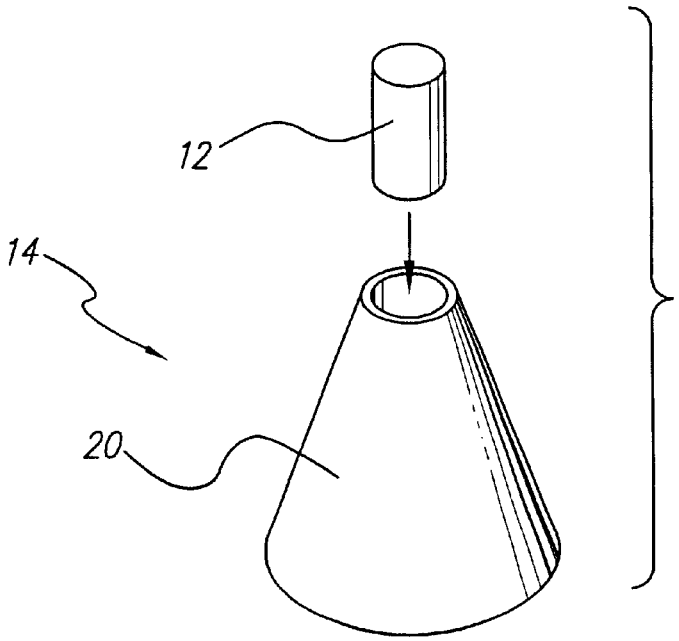
FIG. 1B shows the CIC hearing aid and its charging reservoir.

The recharging system of the invention is shown in FIG. 1B. The recharging system comprises a simple charging reservoir 14 that the CIC hearing aid 12 is dropped into for charging. The CIC hearing aid 12 has a substantially cylindrical shape. The only alignment requirement for charging is that the longitudinal axis of the CIC hearing aid 12 be aligned with the opening in the charging reservoir 14. A reservoir body 20 is shown in FIG. 1B as having a conical shape. This shape is merely used as an example, and those skilled in the art will recognize that many other shapes may be used and do not depart from the scope of the present invention.

Figure 2A:
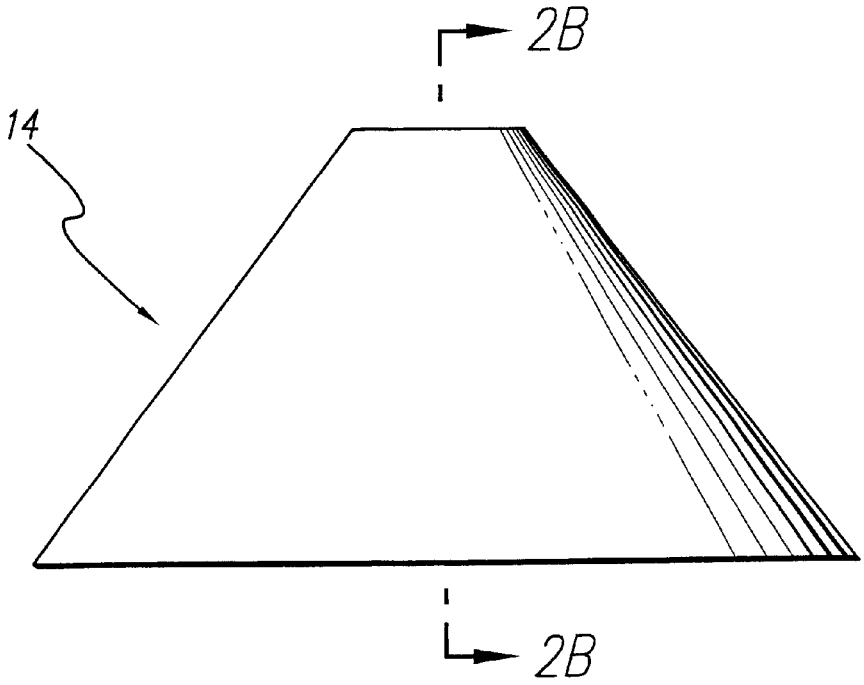
FIG. 2A provides a side view of a charging reservoir.
Figure 2B:
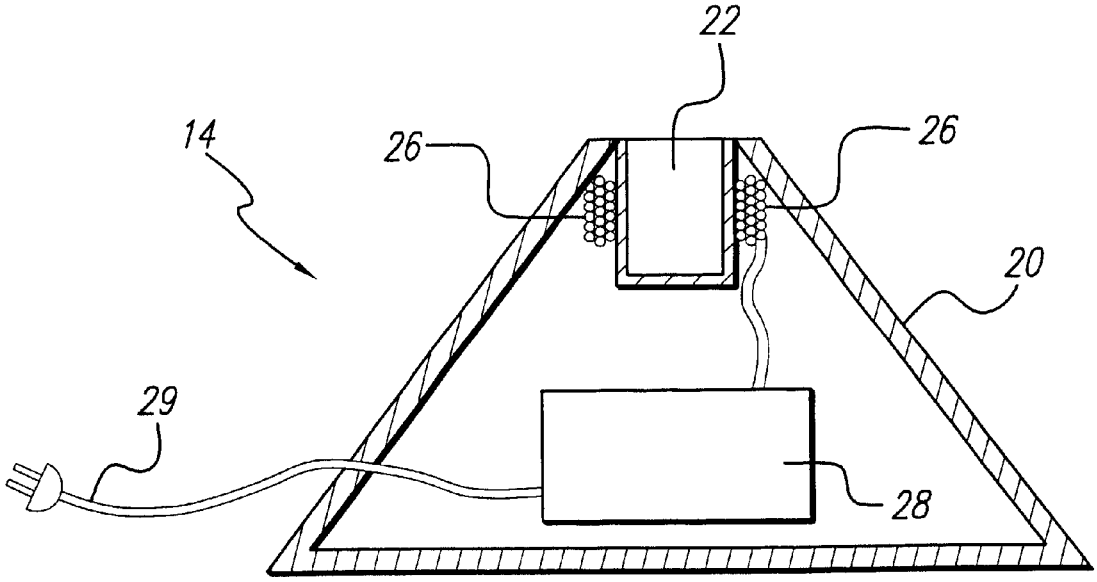
FIG. 2B shows a cross-sectional view of the charging reservoir, taken along line 2B—2B of FIG. 2A.

A side view of the charging reservoir 14 is shown in FIG. 2A. A cross-sectional view of the charging reservoir 14 taken along line 2B—2B of FIG. 2A is shown in FIG. 2B. A reservoir throat 22 provides for the removable insertion of the CIC hearing aid 12 into the charging reservoir 14. The reservoir throat 22 is designed to allow easy insertion of the CIC hearing aid 12 with the only requirement being that the CIC hearing aid is longitudinally aligned with the axis of the reservoir throat. A primary coil 26 is oriented coaxial with the reservoir throat 22, and near the top of the reservoir throat. Advantageously, this positioning of the primary coil provides a maximum degree of freedom in placement of the CIC hearing aid 12 within the charging reservoir, as will be discussed in the description of FIG. 4 below. A reservoir circuit 28 provides power to the primary coil 26. The reservoir circuit 28 comprises a known class E, or similar power amplifier, operating at a carrier frequency from 20 KHz to 100 KHz. Power is provided to the charging reservoir 14 through a power cord 29 which provides for connection to a typical wall outlet. Though this embodiment teaches a charger powered by household power, a battery or otherwise powered unit may also be utilized, thus allowing recharging in a car or anywhere that household power is not available. The use of other alternative power sources will be apparent to those skilled in the art and are intended to come within the scope of the present invention.

Figure 3A:
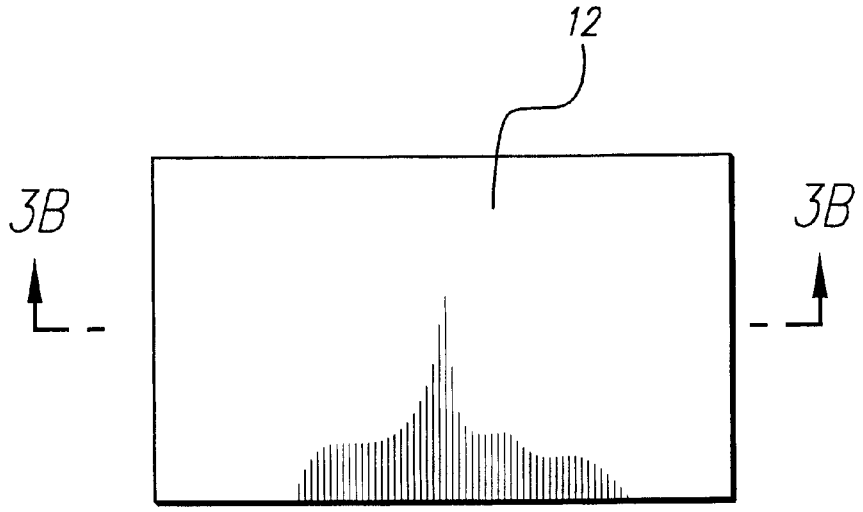
FIG. 3A provides a side view of a CIC hearing aid.
Figure 3B:
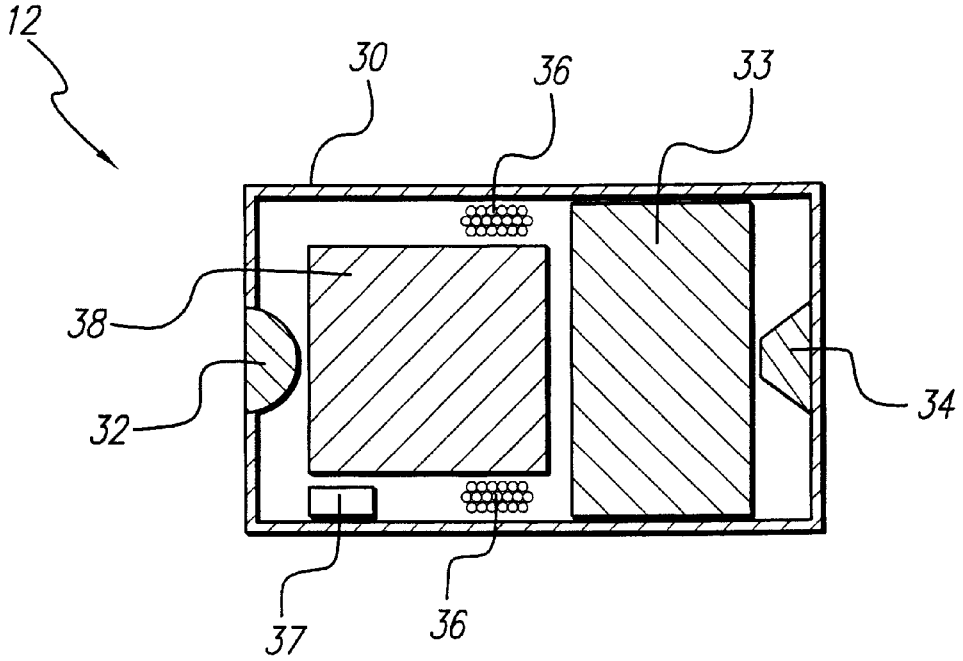
FIG. 3B shows a cross-sectional view of a CIC hearing aid taken along line 3B—3B of FIG. 3A.

Moving to FIG. 3A, a side view of the CIC hearing aid 12 is shown. A cross-sectional view of the CIC hearing aid 12 taken along line 3B—3B of FIG. 3A is shown in FIG. 3B. While a hearing aid body 30 is substantially cylindrical, known CIC hearing aids bodies are molded to fit the user's ear canal. The molded CIC bodies may have a slight turn, and be somewhat out of round. These and other shapes are intended to come within the scope of the present invention.

The basic hearing aid functions are carried out by a microphone 32 that converts sound waves to electrical signals. The electrical signals are processed by the Signal Processor (SP) circuit 33. The processed signal is provided to a speaker 34 that provides an amplified acoustic signal to the hearing aid user. A secondary coil 36 is tuned to the same carrier frequency as the primary coil 26 of FIG. 2B, and receives, rectifies, and filters the power transmitted by the primary coil 26. The processed power is then provided to a charging circuit 37. The output of the charging circuit 37 is used to charge a rechargeable battery 38. The rechargeable battery 38 provides power for the SP circuit 33. The details of the charging circuit 37 are provided in FIG. 5, described below. In a preferred embodiment, the rechargeable battery 38 is a lithium-ion battery. In a second preferred embodiment, the rechargeable battery 38 is a zinc-air battery. The best battery for a specific application of the present invention depends on the space available in the hearing aid, the power requirements of the signal processing circuit, and the individual requirements of the user.

Figure 4:
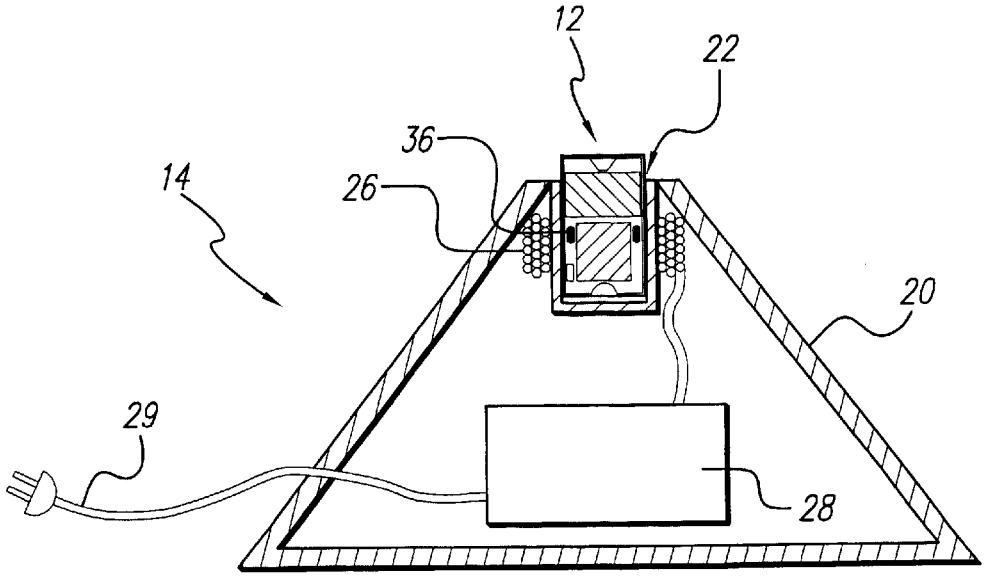
FIG. 4 illustrates the cooperation of primary and secondary coils when the CIC hearing aid in placed in its charging reservoir.

The cooperation of the CIC hearing aid 12 with the charging reservoir 14 is illustrated in FIG. 4. The CIC hearing aid 12 is shown inserted into reservoir throat 22. Importantly, the primary coil 26 is shown surrounding the secondary coil 36. This relationship of the primary to secondary coils maximizes the inductive transmission of power from the primary coil 26 to the secondary coil 36. While the availability of household power reduces the importance of efficient power transfer, applications where the charging reservoir is battery powered benefit significantly from such efficient power transfer. Further, this arrangement of the primary and secondary coils is invariant to rotation of the CIC hearing aid 12. Thus, there is no alignment requirement for the insertion of the CIC hearing aid 12 into the reservoir throat 22. This is particularly advantageous for hearing aid users with poor eyesight. Still further, the vertical placement of the primary and secondary coils results in effective coupling regardless of which end of the CIC hearing aid 12 is inserted into the reservoir throat 22. While this particular arrangement provides marked advantages to older users, other locations for the primary and secondary coils, that are less effective, will be apparent to those skilled in the art and are within the scope of the present invention.

Figure 5:
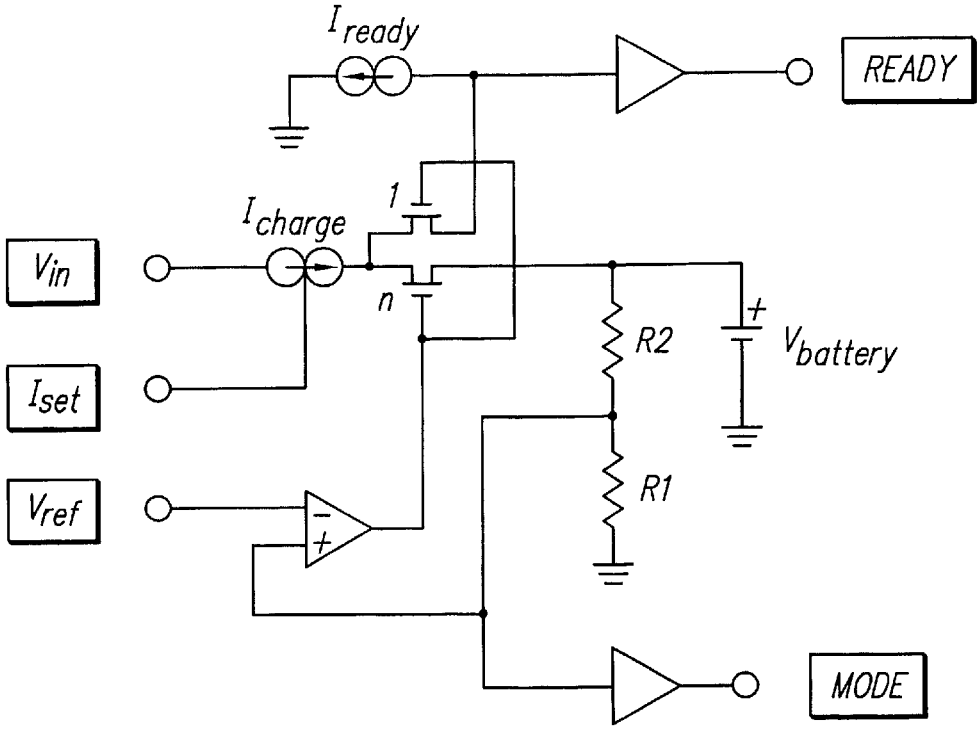
FIG. 5 provides a diagram of a charging circuit suitable for a rechargeable lithium battery.

A charging circuit for a CIC hearing aid 12 using a lithium-ion (Li-Ion) rechargeable battery, or any battery with similar charging requirements, is shown in FIG. 5. Effective charging of a Li-Ion battery requires a charger that operates in two modes. In a first mode of charging, the charger charges at a constant current determined by an input Iset. When the battery voltage, Vbattery, reaches a voltage threshold, Vthresh, the charger switches to a second mode. The voltage threshold Vthresh is a function of resisters R1 and R2, and an input reference voltage, Vref:

$$V\text{thresh}=[(R1+R2)/R1]*V\text{ref}$$

In the second mode, the charger charges at a constant voltage. When the charging current, Icharge, drops below a current threshold, Cthresh, the charging is terminated and the battery is ready for use. The current threshold, Cthresh, is a function of an input reference current, Iready:

$$C\text{thresh}=n*I\text{ready}$$

The Ready signal is changed to indicate a fully charged battery.

While this description is directed to a CIC hearing aid, the inductive charging system taught by the present invention also applies to other hearing aid types. The invention applies directly to an In-The-Canal (ITC) hearing aid. The ITC hearing aid partially enters the ear canal, and thus has a cylindrical part that is similar to the CIC hearing aid. The secondary coil may be built into the cylindrical part, and the cylindrical part is inserted into the reservoir throat, just as the CIC hearing aid is inserted into the charging reservoir for charging. Other hearing aids that have no cylindrical part may similarly be used with a charging reservoir that has a bowl shaped reservoir throat.

Thus, the use of inductive charging with any hearing aid type eliminates the requirement for a precise alignment of the hearing aid with the charging reservoir, and as a result the casual placement of the hearing aid within the reservoir throat is sufficient for effective charging. The inductive charging circuit of the embodiment described herein preferably utilizes a class E power amplifier. Other known inductive charging circuits will be apparent to those skilled in the art, and are within the scope of the present invention.

While the principal use of the secondary coil, as described above, is to provide power to recharge the rechargeable battery, the secondary coil may have other uses. U.S. Pat. No. 5,876,425, issued Mar. 2, 1999 for "Power Control Loop for Implantable Tissue Stimulator" describes the cooperation of a primary and a secondary coil to both provide control signals and back telemetry of data. The circuit described in the '425 patent may similarly be used in a CIC or other hearing aids to provide a means to control the hearing aid remotely, and to back transmit diagnostic messages. The '425 patent is incorporated herein by reference.

While the invention herein disclosed has been described by means of specific embodiments and applications thereof, numerous modifications and variations could be made thereto by those skilled in the art without departing from the scope of the invention set forth in the claims.

What is claimed is:

1. A rechargeable hearing aid system comprising:

a hearing aid, wherein the hearing aid includes an energy storage device that is rechargeable, and wherein the hearing aid includes a secondary coil coupled to the energy storage device; and an inductive charger including a primary coil and a reservoir throat, wherein the primary coil completely encircles and is coaxial with the reservoir throat, wherein the energy storage device of the hearing aid is rechargeable by the inductive charger without removal of the energy storage device from the hearing aid; and wherein the hearing aid is adapted to be inserted into the reservoir throat for charging, and wherein when the hearing aid is inserted into the reservoir throat for charging the primary coil surrounds the secondary coil and is inductively coupled therewith, thereby allowing an efficient inductive transmission of power from the primary coil to the energy storage device through the secondary coil.

2. The rechargeable hearing aid system of claim 1 wherein the reservoir throat includes:

a reservoir body;

a reservoir circuit that includes said primary coil, and means for providing power to the reservoir circuit and the primary coil.

3. The rechargeable hearing aid system of claim 2 wherein the means for providing power is a power cord connectable to household power.

4. The rechargeable hearing aid system of claim 2 wherein the reservoir throat is substantially cylindrical, and wherein the primary coil is substantially coaxial with the reservoir throat, and wherein the hearing aid has at least some substantially cylindrical part, and wherein the cylindrical part is removably insertable into the reservoir throat, and wherein the secondary coil is substantially coaxial to the cylindrical part.

5. The rechargeable hearing aid system of claim 4 wherein the hearing aid comprises a Completely-In-the-Canal (CIC) hearing aid or an In-The-Canal (ITC) hearing aid, and wherein the cylindrical part is removably insertable into the ear canal for hearing aid use.

6. The rechargeable hearing aid system of claim 2 wherein the secondary coil also serves as a receiving and transmitting antenna for receiving control signals and transmitting back telemetry data, and wherein the hearing aid includes means to process and execute control signals received through the secondary coil and means for transmitting back telemetry data through the secondary coil; and wherein the primary coil also serves as a transmitting and receiving antenna for transmitting control signals and receiving back telemetry data, and wherein the inductive charger includes means for generating control signals transmitted through the primary coil and means for processing back telemetry data received through the primary coil.

7. The rechargeable hearing aid system of claim 1 wherein the energy storage device comprises a rechargeable battery.

8. The rechargeable hearing aid system of claim 7 wherein the rechargeable battery is a rechargeable lithium ion battery.

9. The rechargeable hearing aid system of claim 7 wherein the rechargeable battery is a rechargeable zinc air battery.

10. A rechargeable Completely-In-the-Canal (CIC) or In-The-Canal (ITC) hearing aid system comprising:

a hearing aid having a substantially cylindrical part for insertion into an ear canal, and further having a rechargeable battery and a secondary coil coupled to the rechargeable battery;

a charging reservoir having a reservoir throat and a primary coil, wherein the primary coil surrounds and is coaxial with the reservoir throat to permit efficient inductive coupling between the primary coil and the secondary coil of the CiC hearing aid when the CIC hearing aid is placed in the reservoir throat, wherein the hearing aid is inductively rechargeable through cooperation with the charging reservoir.

11. The rechargeable hearing aid system of claim 10 wherein the charging reservoir further comprises:

a reservoir body;

wherein the reservoir throat is an opening in the reservoir body, and wherein the reservoir throat accepts the cylindrical part of the hearing aid;

a reservoir circuit;

wherein the reservoir circuit provides power to the primary coil to create a magnetic field for inductive power transmission to the hearing aid, and wherein the primary coil surrounds the secondary coil when the reservoir throat accepts the cylindrical part of the hearing aid; and means for providing power to the reservoir circuit; and wherein the hearing aid further comprises:

a charging circuit, wherein the primary coil cooperates with the secondary coil as processed and controlled by the charging circuit to charge the rechargeable battery, and wherein the rechargeable battery provides power for the hearing aid;

a microphone;

a signal processing (SP) circuit; and a speaker, wherein a signal from the microphone is processed by the SP circuit to provide a signal to the speaker.

12. The rechargeable hearing aid system of claim 11 wherein the rechargeable battery is a lithium ion battery.

13. The rechargeable hearing aid system of claim 11 wherein the rechargeable battery is a zinc air battery.

* * * * *